US006692048B2

(12) United States Patent
Martin

(10) Patent No.: US 6,692,048 B2
(45) Date of Patent: Feb. 17, 2004

(54) ADJUSTABLE ENGAGING HEAD FOR A CARPET STRETCHER

(76) Inventor: John H. Martin, 5530 Owensmouth Ave., #118, Woodland Hills, CA (US) 91367-7023

( * ) Notice: Subject to any disclaimer, the term of this patent is extended or adjusted under 35 U.S.C. 154(b) by 84 days.

(21) Appl. No.: 10/010,036

(22) Filed: Dec. 6, 2001

(65) Prior Publication Data

US 2003/0107225 A1 Jun. 12, 2003

(51) Int. Cl.[7] ..... A47G 27/04
(52) U.S. Cl. ..... 294/8.6; 254/200
(58) Field of Search ..... 294/8.6, 61; 254/200, 254/209, 212; D8/15; 227/12, 13

(56) References Cited

U.S. PATENT DOCUMENTS

| | | | | | |
|---|---|---|---|---|---|
| 2,184,019 | A | * | 12/1939 | Owens | 294/8.6 |
| 2,631,403 | A | * | 3/1953 | Hopkins | 294/8.6 |
| 2,882,642 | A | * | 4/1959 | Hill | 294/8.6 |
| 3,441,252 | A | * | 4/1969 | Koppelmans | 294/8.6 |
| 3,498,661 | A | * | 3/1970 | Graziano | 294/8.6 |
| 3,866,964 | A | * | 2/1975 | Prater | 294/8.6 |
| 3,940,170 | A | * | 2/1976 | Williams | 294/8.6 |
| 4,008,879 | A | * | 2/1977 | Youngman | 254/201 |
| 4,119,338 | A | * | 10/1978 | Agcaoili | 294/8.6 |
| 4,361,311 | A | * | 11/1982 | Koroyasu et al. | 254/200 |
| 4,627,653 | A | * | 12/1986 | Koroyasu | 294/8.6 |
| 5,129,696 | A | * | 7/1992 | Underwood | 294/8.6 |
| 5,190,328 | A | * | 3/1993 | Anderson | 294/8.6 |

* cited by examiner

*Primary Examiner*—Eileen D. Lillis
*Assistant Examiner*—Paul T. Chin
(74) *Attorney, Agent, or Firm*—O'Melveny & Myers LLP

(57) ABSTRACT

An engaging head for a carpet stretcher is disclosed. The engaging head comprises a body, having a leading edge, a carpet-facing side extending in a trailing direction from the leading edge, and an upper side opposite to the carpet-facing side. A leading cotton-head is disposed on the carpet-facing side parallel and adjacent to the leading edge. Trailing cotton-heads are disposed on the carpet-facing side behind the leading cotton-head and transverse to the leading edge, and pin-teeth are disposed on the carpet-facing side and interspersed between the trailing cotton-heads. In an embodiment of the invention, a portion of the body adjacent to the leading cotton-head is substantially wider in a direction parallel to the leading edge than a trailing portion of the body whereon the trailing cotton-heads and the pin teeth are disposed. The body of the engaging head, when viewed in a direction looking towards the carpet-facing side, may be T-shaped. Optionally, an adjustment mechanism is mounted to the body and connected to the trailing cotton-heads, operative to extend the trailing cotton-heads from the body. A further option is to provide adjustment mechanism mounted to the body and connected to the leading cotton-head, to retract the leading cotton-head into the body.

20 Claims, 4 Drawing Sheets

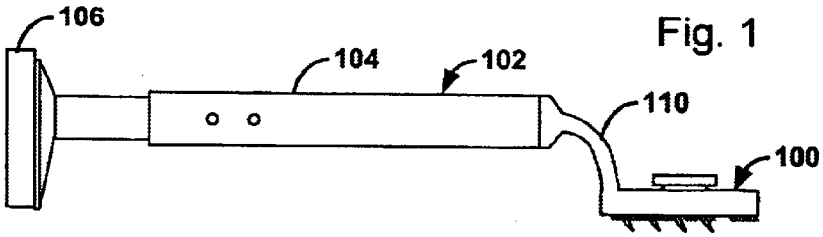
Fig. 1
Fig. 2
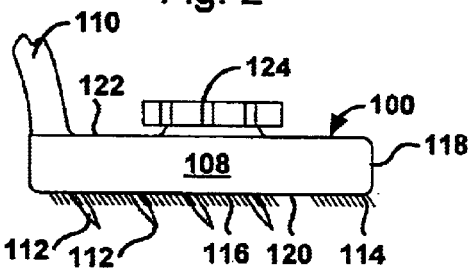
Fig. 3
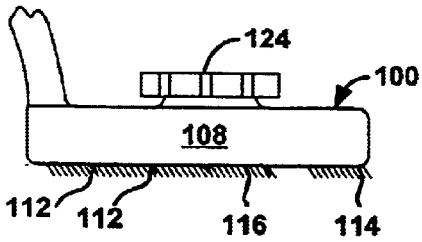
Fig. 4
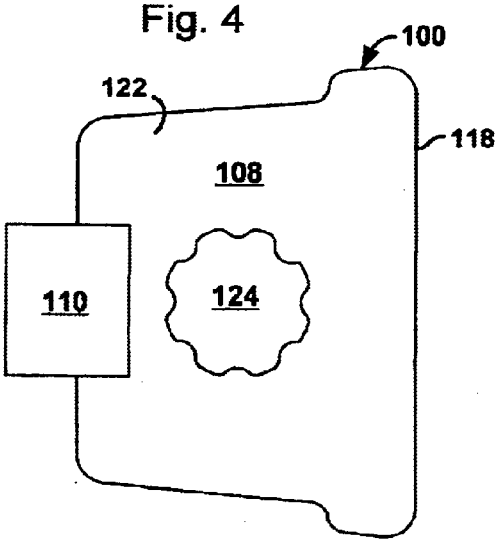
Fig. 5
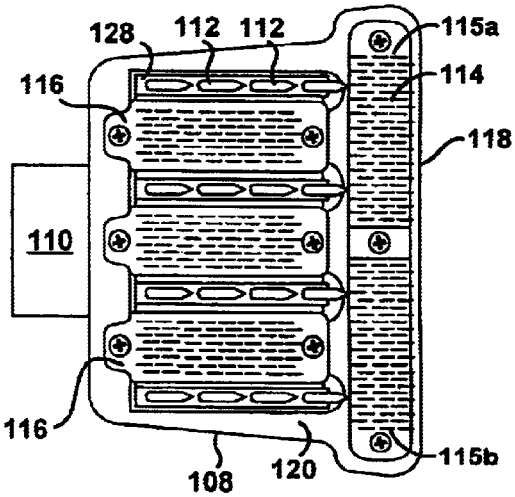

ADJUSTABLE ENGAGING HEAD FOR A CARPET STRETCHER

BACKGROUND OF THE INVENTION

1. Field of the Invention

The present invention relates to tools for installation of wall-to-wall carpeting, and particularly, to tools used for stretching and positioning carpet materials during installation.

2. Description of Related Art

In the installation of wall-to-wall carpeting, the carpet material is often attached to the floor to be covered around the periphery of the floor area, such as adjacent to the walls of a room. Thin, narrow strips of wood or like material having a plurality of sharp tacks protruding therefrom, referred to as "tack strips", are typically fastened to the periphery of the floor for this purpose. The carpet material is then temporarily attached to the tack strips along one edge of the floor area, stretched across the floor, and attached to the tack strips along an opposite edge of the floor area. The process is repeated with any remaining unattached edges of the carpet, until the carpet has been positioned and stretched as desired. The carpet may then be more permanently attached to the floor by flattening the tacks in the tack strip using a suitable hammering or flattening tool.

Various tools are used in the construction trade for stretching and positioning carpet onto the tack strips. One type of tool is exemplified by the relatively large, lever-activated stretching tools referred to as "power stretchers." Power stretchers typically comprise an extensible tube with a leveraged extension mechanism, a carpet engaging head at a first end of the tube, and a suitable pressure plate at the other end of the tube. The pressure plate is placed against a wall or other suitable stationary structure, and the tube is placed along the carpet material in the desired direction of stretch. The engaging head is engaged with the carpet, and the tube is extended a desired amount using the lever mechanism. As their name suggests, power stretchers are particularly useful for imparting a large amount of stretch to carpet. However, they are relatively large and may not be suitable for odd-shaped floor areas or for working in tight spaces.

Another popular type of tool in the trade is exemplified by the portable, impact-operated stretching and positioning tools referred to as "kickers." Kickers typically comprise a relatively short tube (less than three feet, and more typically, about eighteen inches long) with a carpet engaging head on one end and a cushioned pad on the opposite end. Kickers are operated by impacting the cushioned pad while the engaging head is engaged in the carpet. An installer typically kneels astride the kicker and impacts the cushioned pad using the thigh and/or knee of one leg, while positioning the engaging head between strokes as desired. Using a kicker, a skilled installer can very quickly work around the periphery of a room or other area to be carpeted, stretching the carpet and fastening it to the tack strips. Being relatively small and versatile, kickers are especially preferred for use in tight spaces and with odd-shaped carpet areas. They are often used with their engaging heads positioned quite close to a tack strip, and often come into contact with the edges of tack strips during use. Contact with the edge of the tack strip is not desirable, because the engaging head and/or the tack strip may become damaged by repeated contact. Also, because the tack strip is relatively immovable, striking the tack strip may cause additionally impulses to be felt by the user of the kicker, increasing the likelihood of fatigue and/or injury.

Power stretchers and kickers both use engaging heads comprising a plurality of forwardly-inclined pins for engaging typical carpet materials. Engaging heads may use a large plurality of relatively fine pins for engaging relatively loose tufted carpet, such as most cut-pile carpeting. The relatively fine pins are typically mounted in arrays on plates known as cloth carding pin plates, also called "cotton-heads." Relatively large, teeth-like spikes or pins, referred to as pin teeth, are used for engaging more tightly woven carpeting with dense backings, that the cotton-heads do not engage well. It is known for both types of pins to be incorporated into a single engaging head, with the pin teeth rotated into and out of position as needed.

However, engaging heads according to the prior art suffer from various disadvantages. The configuration of pin plates and pin teeth in prior art heads is not optimized for engaging carpet close to the leading edge of the engaging head, and does not grip the carpet as evenly as desired, which may cause wrinkles. The mechanism for raising and lowering the pin teeth does not operate as smoothly as desired. The relatively fine pins in the pin plates close to the leading edge of prior art engaging head are often damaged by contact with tack strips. It is desired, therefore, to provide an engaging head for a carpet stretcher, and particularly, for a kicker-type stretcher, that overcomes the limitations of prior art engaging heads.

SUMMARY OF THE INVENTION

The present invention provides an adjustable engaging head that overcomes the limitations of prior art engaging heads. The engaging head comprises a T-shaped body with the top of the T-shape oriented towards the forward edge of the engagement head. A strip of cloth carding pins is located along the top of the T-shape adjacent to the forward edge and on the underside (carpet side) of the engagement head. Behind the forward strip of cloth carding pins, in the base of the T-shape, an array of trailing cloth carding pins are provided, interspersed with an array of pin teeth. In an embodiment of the invention, the pin teeth are mounted on a plate that may be adjusted towards and away from the carpet (i.e., up and down). The position of the pin-teeth plate is adjusted using a screw mechanism attached to an adjustment knob on the top of the engagement head. The pin-teeth plate is guided by vertical rails in the interior of the engagement head. The vertical rails fit into corresponding recesses in the pin-teeth plate. The trailing cloth carding pins are on plates secured to a frame of the engagement head. An assembly of cloth carding pins (or pins of similar size and shape) together with a mounting plate for holding the pins in position, is herein referred to as a "cotton-head."

In another embodiment of the invention, the pin teeth are secured to a frame of the engagement head, instead of being movable. The trailing cotton-heads are secured to a movable plate that is adjustable up and down in a manner similar to the adjustable pin-teeth plate. By extending and retracting the trailing cotton-heads from the engagement head relative to the pin teeth, the pin teeth may effectively be placed in or out of service, depending on the type of carpet that is being stretched. Extending the trailing cotton-heads from the engagement head provides the further advantage of raising the leading cotton-head, which runs across the leading edge of the engagement head, above the tack strips at the periphery of the carpeted areas. As a result, the kicker may be used more easily to position the carpet adjacent to the tack strips, without risk of damage to the pins of the engagement head. In the alternative, or in addition to adjusting the trailing cotton-heads, the leading cotton-head, at the front leading edge of the engagement head, may also be made adjustable. By retracting the leading cotton-head into the engagement head, the leading cotton-head may be protected from damage while working the carpet stretcher adjacent to a tack strip.

In yet another embodiment of the invention, the pin teeth and the trailing cotton-heads are both independently adjustable relative to the engagement head. Dual adjustment mechanisms are provided, such as a co-axial screw mechanism, for independent adjustment of both types of pins. The engagement head may therefore be provided with still greater versatility of adjustment, including being adjustable to each of the pin positions attainable using fixed trailing cotton-heads and movable pin teeth, and likewise, fixed pin teeth and movable trailing cotton-heads.

The engagement head is attached at its trailing edge to a curved transition piece (neck) that connects the head to the drive tube of a kicker. The engagement head may be attached to the transition piece using removable fasteners, such as screws.

A more complete understanding of the adjustable engaging head will be afforded to those skilled in the art, as well as a realization of additional advantages and objects thereof, by a consideration of the following detailed description of the preferred embodiment. Reference will be made to the appended sheets of drawings which will first be described briefly.

BRIEF DESCRIPTION OF THE DRAWINGS

FIG. 1 is a side elevation view of a kicker having an engagement head according to an embodiment of the invention.

FIG. 2 is a side elevation view of an engagement head according to the invention, with the pin teeth fully extended.

FIG. 3 is a side elevation view of the engagement head of FIG. 2, with the pin teeth fully retracted.

FIG. 4 is a top view of the engagement head of FIG. 2, showing the T-shape of the head and the adjustment knob.

FIG. 5 is a bottom (carpet side) view of the engagement head of FIG. 2, showing the leading and trailing cotton-heads, and the pin teeth.

DETAILED DESCRIPTION OF THE PREFERRED EMBODIMENT

Figure 6:
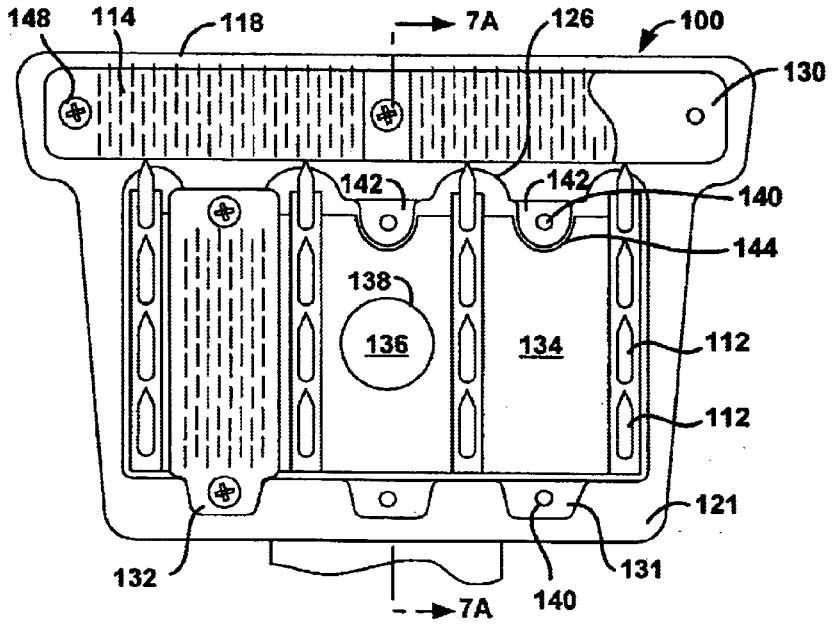
FIG. 6 is a bottom (carpet side) view of the engagement head of FIG. 5, with two of the trailing cotton-heads removed to show the pin-teeth plate, the vertical guide rails, and the adjustment screw.

The present invention provides an adjustable engaging head for a carpet stretcher, that overcomes the limitations of prior are engaging heads. In the detailed description that follows, like element numerals are used to indicate like elements that appear in one or more of the figures. The drawings accompanying the description are sufficiently detailed to permit one of ordinary skill to make and use an engaging head according to the invention, but generally omit certain details such as are known in the art or such as are not essential for understanding the invention. Accordingly, the drawings should be interpreted as conceptual in nature, and not as detailed design drawings of physical embodiments.

Referring to FIG. 1, a side view of an exemplary knee-kicker type of carpet stretcher 102 is shown. Kicker 102 comprises traditional elements for this type of tool, including a kicker shaft 104 which may be adjustable in length, and an impact pad 106 at one end of the tool. At the opposite end of shaft 104, and engagement head 100 is attached to the shaft by a curved neck (transition piece) 110. Curved neck 110 preferably extends away from the leading edge of head 100, and up away from the upper side of the head, as shown. Neck 110 comprises a curved piece of material and may be attached to head 100 and to shaft 104 using any suitable method. Kicker 102 and its load-bearing components are preferably comprised of aluminum, steel, or alloys thereof, structural composites, or other strong, tough materials. Relatively elaborate components, such as the body of the engagement head 100, are preferably formed by casting. Accordingly, an easily casted material, such as aluminum or aluminum alloy, may be preferred for such pieces.

FIGS. 2 and 3 show side views of an exemplary engagement head, at approximately one-half of full scale. However, the size of the engaging head is not a limitation of the invention. FIG. 2 shows the engaging head 100 with the pin-teeth 112 extended from the body 108. The leading cotton-head 114 and the trailing cotton-heads 116 are also visible extending from the carpet-facing side 120 of body 108. An adjustment knob 124 is disposed on the upper surface 122 of body 108. FIG. 3 is a view of the same head 100 with the pin teeth 112 in a retracted position. The kicker 102 may be used with the pin-teeth 112 in the extended or retracted position, or in any intermediate position in between. The pin-teeth and the cotton-head pins are forwardly inclined (inclined towards the leading edge 118 of the body 108), as known in the art.

Both cotton-heads and pin-teeth are known in the art. Cotton-heads, also known as cloth carding plates, comprise relatively thin plates holding an array of cloth carding pins. The cloth carding pins are preferably relatively small, being less than about 1 mm (about 0.04 inches) in diameter, protrude from the plate of the cotton-head about 5 mm (about 0.2 inches) or less, and are arrayed at a spacing of less than about 2 mm (about 0.08 inches). The plate of the cotton-head typically comprises a relatively stiff plastic material, which may be laminated to a metal backing plate.

Various types, styles, and sizes of cotton-heads are available. Any cotton-head suitable for gripping carpet tufts may be used. As shown in FIG. 6, the pin-teeth are preferably much larger than the cotton-head pins, such as greater than about 2.5 mm (about 0.1 inches) in diameter, and are formed with a spiked (conical) tip for penetrating into and holding the carpet backing. The lengths of the pin-teeth are preferably selected to permit the pin-teeth to penetrate into, but not through, the thickest desired carpet when fully extended from the engaging head.

FIGS. 4 and 5 show top and bottom views, respectively, of the engaging head 100. FIG. 4 shows a view looking towards the upper side 122 of body 108, showing knob 124 and curved neck 110. Details of the connection of curved neck 110 to body 108 are not shown. FIG. 5 shows a view looking toward the carpet-facing (bottom) side 120 of body 108. A leading cotton-head 114 is disposed on side 120 parallel and adjacent to leading edge 118. Behind and level with the leading cotton-head, a plurality of trailing cotton-heads 116 are disposed. A plurality of pin-teeth 112 are disposed on side 120 interspersed between individual ones of the plurality of trailing cotton-heads. The pin-teeth 112 are mounted to an integral pin plate 128, visible underneath the pin-teeth.

In both FIGS. 4, and 5, the overall T-shape of body 108 and head 100 is shown. The T-shaped head permits a longer leading cotton-head than would otherwise fit to be mounted adjacent to the leading edge. It is particularly preferable for the leading cotton-head to span or exceed the span of all the trailing teeth (i.e., the plurality of pin-teeth 112 and plurality of trailing cotton-heads 116). FIG. 5 shows the leading cotton-head 114 exceeding the span of the trailing teeth, and having cloth carding pins extending beyond the trailing teeth in a direction parallel to the leading edge 118. That is, the outermost pin rows 115*a* and 115*b* at the opposite ends of the cotton-head 114 are preferably placed outside the outermost rows of the trailing teeth. The gripping action of the leading cotton-head helps to prevent buckling or wrinkling of the carpet in front of the leading edge. The wrinkle-preventing effect of the leading cotton-head is surprisingly enhanced by extending the leading cotton-head past the outer edges of the trailing teeth, thereby maintaining tension on the carpet in advance and beyond the edges of the trailing teeth. A user of the engaging head 100 will notice that it is easier to maintain a flat appearance of the carpet while stretching carpet, compared to prior-art engaging heads. Thus, the T-shaped head configured as described herein enhances the ease of use of kickers which employ it.

FIG. 6 shows a more detailed view of the engaging head 100, taken in the same direction as FIG. 5. The head is shown with two of the trailing cotton-heads and a portion of the leading cotton-head removed to reveal underlying details. Leading cotton-head 114 is preferably in mounted inside a recess 130 in body 108, so that the surface of the cotton-head's mounting plate is flush with the bottom surface 121. Leading cotton-head 114 and the trailing cotton-heads, such as cotton head 132, may be attached to body 108 by any suitable method, such as by fasteners 148 inserted into threaded holes 140.

The portion of the body 108 behind the leading cotton-head is provided with a cavity 126 for accommodating an adjustment mechanism 150 (shown in FIGS. 7A and 7B), comprising the pin-teeth plate 134 and driven screw threads 138 engaged with threaded rod 136. Vertical rails 142 are preferably provided along at least one wall of cavity 126, and extend for substantially the depth of the cavity. Plate 134 is grooved (contoured) at grooves 144 to conform to vertical rails 142, which thereby operate to guide the pin-teeth plate 134 during movement of the plate. Rails 142 and corresponding grooves 144 are preferably curved and essentially free of sharp corners or other features that may interfere with the smooth operation of the pin-teeth plate. It has been demonstrated that rails 142 can provide a noticeable improvement in the smoothness of operation of the adjusting mechanism 150. When plate 134 is guided by the rails 142, rattle, vibration, and sticking-slippage of the pin-teeth plate within the cavity 126 during extension or retraction of the pin teeth can be prevented.

The trailing cotton-heads, such as cotton-head 132, are preferably attached to the top of rails 142 and in rear recess 131, so as to present the surfaces of their plates flush with the bottom surface 121 of body 108. The trailing cotton-heads are preferably interspersed between rows of the pin-teeth 112 to provide a relatively even distribution of different types of teeth across the engaging head, as known in the art.

Figure 7A:
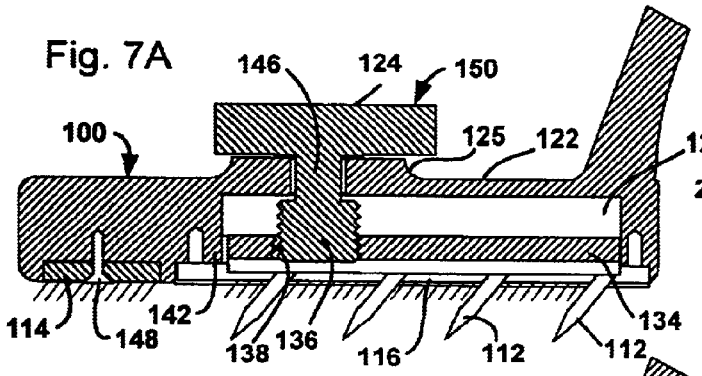
FIG. 7A is a cross-sectional view showing the engagement head of FIG. 5, with the pin-teeth fully extended.
Figure 7B:
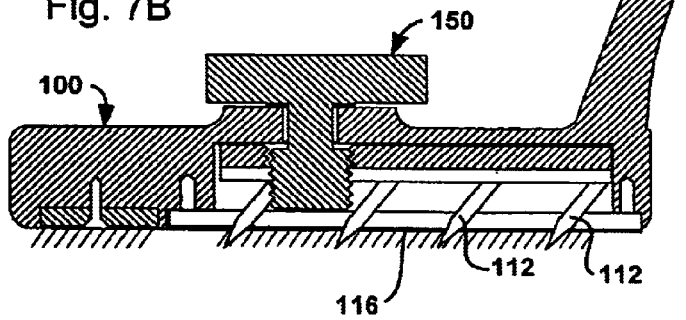
FIG. 7B is a view like FIG. 7A, showing the pin teeth in the fully retracted position.

FIGS. 7A and 7B are cross-sectional views of the engaging head 100, taken along section lines 7A indicated on FIG. 6, showing the pin teeth in an extended and retracted position, respectively. FIG. 7A shows the pin-teeth plate 134 in a fully extended position, preferably just prior to bottoming on back surfaces of the trailing cotton-heads 116. Adjusting mechanism 150 is operative to extend and retract the pin-teeth plate, and comprises an adjustment knob 124 disposed on the upper side 122 of body 108, connected by shaft 146 to an actuator mechanism, such as threaded shaft 136 and driven screw 138, disposed under the upper side of the body, in cavity 126. The details of adjusting mechanism 150 may vary, and are not a feature of the invention. For example, a detent mechanism may be provided under knob 124, so that the position of the adjusting mechanism may be advanced in discrete increments. Preferably, a boss 125 is disposed on the upper side 122 of the body, interposed between the knob 124 and the body. Boss 125 advantageously raises the knob above the body for improved grippability, and provides a space for mounting a detent mechanism (not shown). Alternative types or structures may be used for adjusting mechanism 150, for example, a cam driven mechanism instead of a screw mechanism, without departing from the scope of the invention. Leading cotton-head 114 is fixed to body 108, such as by screw fastener 148.

FIG. 7B shows the adjustment mechanism 150 in a fully retracted position. In the fully retracted position, the tips of pin-teeth 112 preferably do not extend from body 108 past the tips of the cloth carding pins 116, as known in the art. In this position, the engagement head is configured for use with carpets having relatively weak or fragile backings. The pin-teeth may also be partially retracted to prevent the pin-teeth from protruding through the carpet, depending on the thickness or type of the carpet.

Figure 8A:
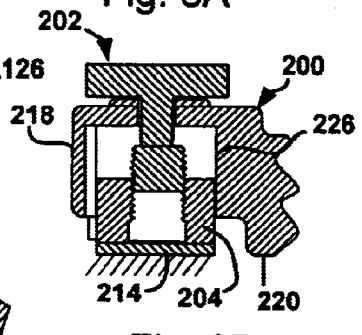
FIG. 8A is a cross-sectional view of a nose portion of an engagement head, according to an embodiment of the invention having an adjustable leading cotton-head, with the cotton-head in an extended position.
Figure 8B:
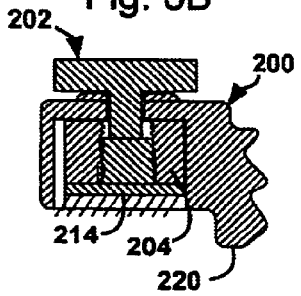
FIG. 8B is a view like FIG. 8A, showing the leading cotton-head retracted into the body of the engagement head.

In another embodiment of the invention, a leading cotton-head 214 is connected to an adjustment mechanism 202 for extending and retracting the leading cotton-head relative to the engagement head 200, as shown by FIGS. 8A and 8B. Adjusting mechanism 202 may comprise a screw mechanism similar to adjusting mechanism 150, or any other suitable type of mechanism may be used. Cotton-head 214 is attached to a movable plate 204, which is free to move within a cavity 226 positioned near the leading edge 218 of the engagement head 200. Optionally, cavity 226 is provide with internal guide rails similar to rails 142 of cavity 126. Mechanism 202 may be used to protect the leading cotton-head 214 from damage while working the engagement head adjacent to a tack strip or other obstacle in a floor surface. By retracting the cotton-head 214 towards head 200, contact with the obstacle may be avoided. The portion of the engagement head 200 adjacent to the leading edge may be recessed relative to bottom side 220 of the trailing portion, as shown. In the alternative, the leading portion may be flush with the trailing portion as described in connection with the engagement head 100. Recessing the leading portion of the head 200 provides the advantage of raising it above obstacles such as tack strips, thereby preventing undesirable collisions between the engagement head and such obstacles. FIG. 8A shows the cotton-head in a fully extended position, preferably flush with a bottom surface 220 of the engagement head and aligned with the level of the trailing cotton-heads (not shown). FIG. 8B shows the cotton-head in a retracted position, with the cotton-head pins recessed below the bottom surface of the engagement head.

Figure 9:
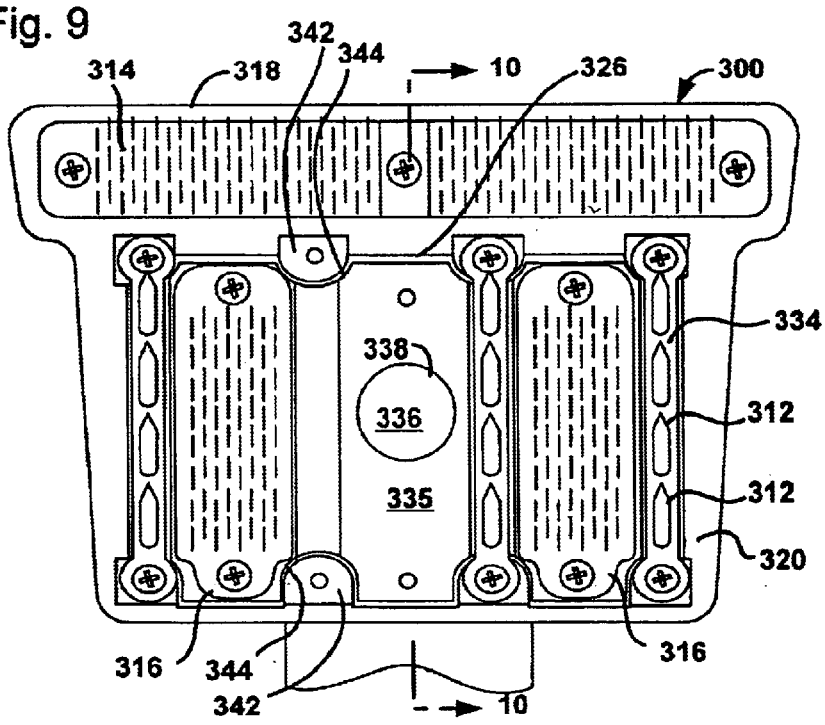
FIG. 9 is a bottom (carpet side) view of an engagement head according to an embodiment of the invention wherein the pin teeth are fixed and the trailing cotton-heads are movable.
Figure 10:
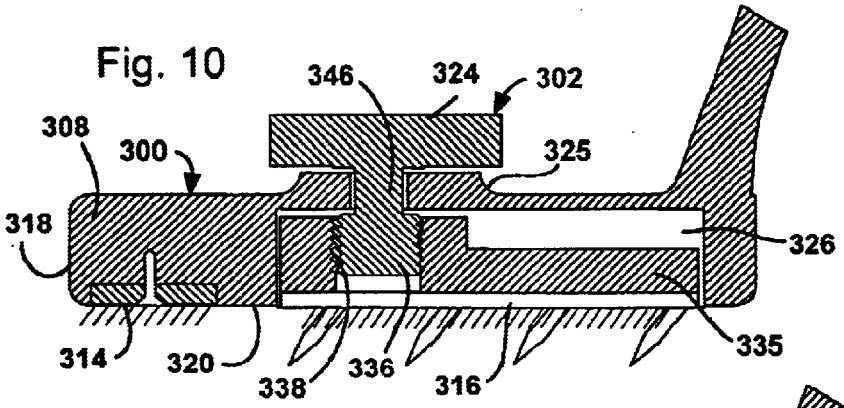
FIG. 10 is a cross-sectional view of the engagement head shown in FIG. 9, showing the trailing cotton-heads in a fully retracted position.
Figure 11:
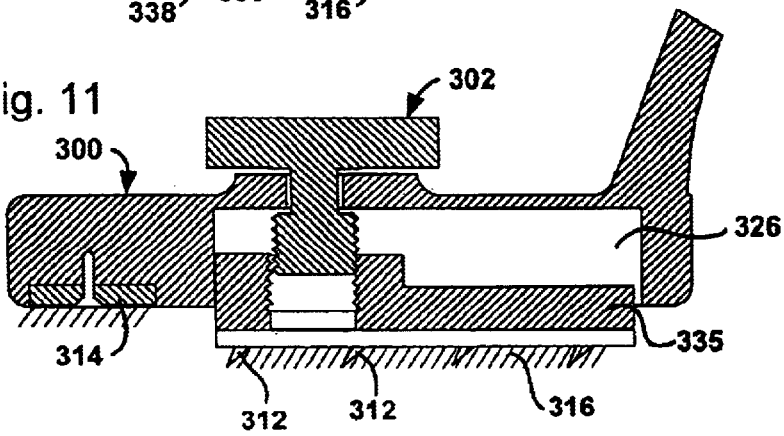
FIG. 11 is a view like FIG. 10, showing the trailing cotton-heads in a fully extended position.

In an alternative embodiment, as shown in FIGS. 9–11, the pin teeth are mounted in a fixed position relative to body 308, and the plurality of trailing cotton-heads are connected to an adjusting mechanism for extending and retracting them relative to the body. This configuration can offer functionality comparable to movable pin-teeth, and in addition, can provide the benefit of elevating the leading cotton-head when working the tool adjacent to a tack strip. FIG. 9 shows a view of an engaging head 300 looking towards the carpet-facing side 320, with a central one of the plurality of trailing cotton-heads 316 and one row of pin-teeth 312 removed to reveal a portion of an adjusting mechanism and mounting faces for the pin-teeth. The plurality of trailing cotton-heads 316 are attached to a movable plate 335 in cavity 326. Plate 335 is driven by threaded shaft 336 in engagement with driven threads 338. The pin-teeth 312 are fixedly mounted to body 308, such as by mounting in groups to bars 334, which are in turn attached to body 308, as shown. The leading cotton-head 314 may be as previously described, or in the alternative, may be omitted. Vertical rails 342 may be provided along the walls of cavity 326 for guidance of plate 335, and corresponding grooves 344 in plate 335. Rails 342 and grooves 344 preferably operate similarly to rails 142 and grooves 144 previously described.

Operation of the adjusting mechanism 302 is illustrated by FIGS. 10 and 11. FIG. 10 shows the movable cotton-head plate 335 in a fully retracted position. The pins of the trailing cotton-heads 316 preferable protrude from the engaging head in the retracted position. Adjusting mechanism 324 may comprise a knob 324 connected to threaded shaft 336 by shaft 346. Turning the knob causes the threaded shaft 336 to advance in driven threads 338 of plate 335. A boss 325 may be interposed between the knob 324 and body 308. In lieu of a screw mechanism, any suitable adjusting mechanism may be used, such as a cam mechanism. In the retracted position, the engaging head is configured for use on tightly woven carpets with relatively tough backing materials; i.e., configured comparably to engaging head 100 with its pin-teeth 112 extended.

FIG. 11 shows the engaging head 300 with the cotton-head plate 335 in an extended position. In the position shown, plate 335 is extended until the pin-teeth do not extend beyond the cotton-heads 316, as shown. In this extended position, the engaging head 300 is configured for use on carpets with relatively weak backing materials; i.e., configured comparably to engaging head 100 with its pin-teeth 112 retracted. Additionally, lowering the trailing cotton-heads 316 has the same effect as raising (retracting) the leading cotton-head 314, thereby configuring head 300 for working adjacent a tack strip or other obstacle. If the effective retraction of leading cotton-head 314 is not desired, the leading cotton-head may be made to extend with the trailing cotton-heads 316, either by linking the leading cotton-head directly to movable plate 335, or through the use of a separate adjusting mechanism, such as mechanism 202 previously described in connection with FIGS. 8A–8B.

Figure 12:
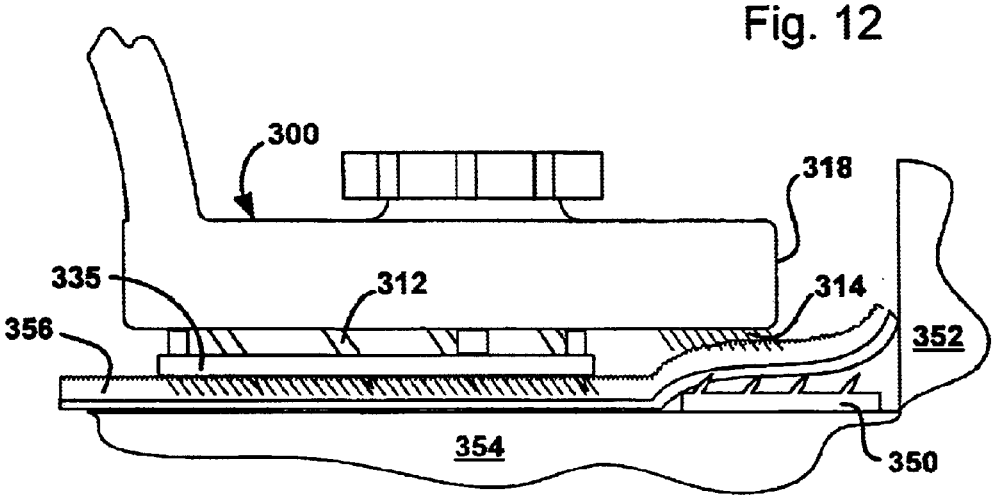
FIG. 12 is a side view of an engagement head according to an embodiment wherein the pin teeth and trailing cotton-heads are independently movable. The head is shown in relation to a carpet and tack strip (the carpet is shown as a transparent element).

FIG. 12 is an end view of an engaging head 300 with movable trailing cotton-heads, while in use on a kicker working to stretch carpet 356 on floor 345 adjacent to a tack strip 350 against wall 352. For illustrative simplicity, certain details have been omitted, such as carpet padding that is typically present underneath wall-to-wall carpet. The moveable plate 335 and the trailing cotton-heads 316 are shown in an extended position, thereby effectively raising the leading cotton-head 314 above the level of the tack strip 350. The pins of the leading cotton-head are thereby protected from damage. Also, the leading edge 318 of the engagement head is raised above the tack strip, which prevents undesirable butting against the tack strip, thereby reducing shock loading on the engagement head and user, and protecting the tack strip from damage. Similar advantages may be realized by recessing the leading portion of the engagement head and/or by making the leading cotton-head retractable/extendable, as previously described in connection with FIGS. 8A–8B.

Figure 13:
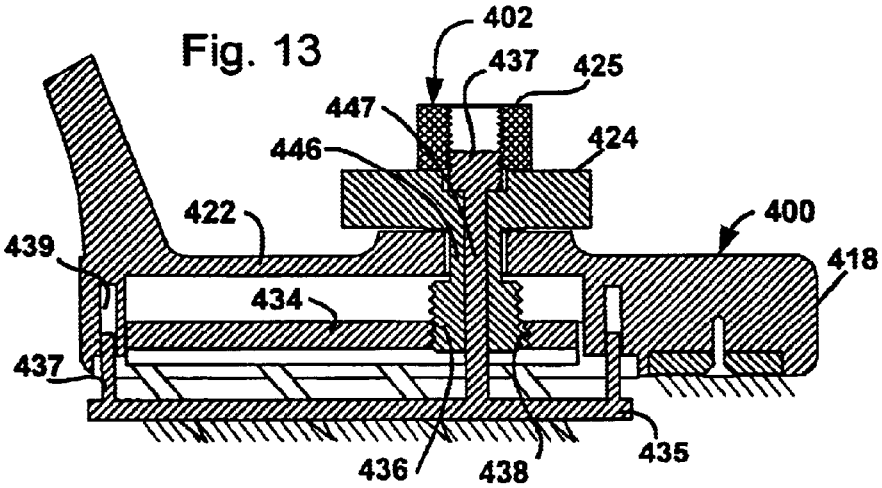
FIG. 13 is a cross-sectional view showing an engagement head according to an embodiment wherein the pin teeth and trailing cotton-heads are both adjustable.

From inspection of FIG. 12, it is evident that a disadvantage of the embodiment shown is that the pin-teeth 312 cannot be used when the trailing cotton-heads are in a fully extended position. Conversely, when the cotton-heads are retracted, the pin-teeth are effectively extended, and must be used. These disadvantage may be overcome by also providing for movement of the pin-teeth. FIG. 13 shows another alternative embodiment of the invention wherein the engagement head 400 comprises a pin-teeth plate 434 and a cotton head plate 435, that are independently movable using a co-axial screw mechanism 402. Pin-teeth plate 434, threaded shaft 436 and driven threads 438, shaft 446, and knob 424 may be configured similarly to the corresponding plate 134, threaded shaft 136, driven threads 138, shaft 146, and knob 124 of engagement head 100. Additionally, the trailing cotton-heads are movable, such as by being mounted on a movable plate 435 guided by protrusions (such as pins) 437 which fit into corresponding wells 439 in the body of the engagement head. The movable plate 435 may be driven by a separate actuator mechanism, such as comprising internally threaded knob 425, drive 437, and shaft 447 passing through shaft 446. Any suitable adjustment mechanisms may be used for extending and retracting the pin-teeth plate 434 and the cotton-head plate 435 of engagement head 400, and the invention is not limited by the co-axial screw mechanism. FIG. 13 shows the head 400 with both of the pin-teeth plate 434 and the cotton-head plate 435 in an extended position. It should be apparent that, when both the pin teeth and the trailing cotton-heads are movable, the head can be configured so that any combination of relative positions may be achieved during use of the head.

Having thus described a preferred embodiment of the adjustable engaging head, it should be apparent to those skilled in the art that certain advantages of the within system have been achieved. It should also be appreciated that various modifications, adaptations, and alternative embodiments thereof may be made within the scope and spirit of the present invention. For example, engagement heads using particular types of adjustment mechanisms have been illustrated, but it should be apparent that the inventive concepts described above would be equally applicable to engagement heads using other types of adjustment mechanisms. The invention is further defined by the following claims.

What is claimed is:

1. An engaging head for a carpet stretcher, comprising:

a body, having a leading edge, a carpet-facing side extending in a trailing direction from the leading edge, and an upper side opposite to the carpet-facing side;

a leading cotton-head disposed on the carpet-facing side parallel and adjacent to the leading edge;

a plurality of trailing cotton-heads disposed on the carpet-facing side behind the leading cotton-head transversely to the leading edge; and a plurality of pin-teeth disposed on the carpet-facing side and interspersed between the plurality of trailing cotton-heads.

2. The engaging head of claim 1, wherein a portion of the body adjacent to the leading cotton-head is substantially wider in a direction parallel to the leading edge than a trailing portion of the body whereon the plurality of trailing cotton-heads and the plurality of pin teeth are disposed.

3. The engaging head of claim 2, wherein the body is a substantially T-shaped body.

4. The engaging head of claim 2, wherein the leading cotton-head extends in a length direction for substantially an entire length of the leading edge.

5. The engaging head of claim 1, further comprising an adjustment mechanism mounted to the body and connected to the plurality of pin-teeth, operative to extend the plurality of pin-teeth from the body and to retract the plurality of pin-teeth towards the body.

6. The engaging head of claim 5, wherein the adjustment mechanism further comprises a plurality of vertical rails in the body of the engaging head, and a movable plate mounted to the plurality of pin-teeth and contoured to ride on the plurality of vertical rails.

7. The engaging head of claim 5, wherein the adjustment mechanism further comprises a knob disposed on the upper side of the body and connected to an actuator mechanism disposed under the upper side of the body by a shaft passing through the body.

8. The engaging head of claim 7, wherein the body further comprises a boss on the upper side of the body interposed between the body and the knob.

9. The engaging head of claim 1, further comprising an adjustment mechanism mounted to the body and connected to the plurality of trailing cotton-heads, operative to extend the plurality of trailing cotton-heads from the body, and to retract the plurality of trailing cotton-heads towards the body.

10. The engaging head of claim 1, further comprising an adjustment mechanism mounted to the body and connected to the leading cotton-head, operative to extend the leading cotton-head from the body, and to retract the leading cotton-head towards the body.

11. The engaging head of claim 10, wherein a portion of the body adjacent to and along the leading edge is recessed below a bottom surface of the carpet facing side behind the leading cotton-head.

12. The engaging head of claim 1, wherein the leading cotton-head extends for substantially the length of the leading edge and further comprises an array of cloth carding pins spanning beyond opposite outermost pin rows of the plurality of trailing cotton-heads and the plurality of pin-teeth.

13. An engaging head for a carpet stretcher, comprising:

a body, having a leading edge, a carpet-facing side extending in a trailing direction from the leading edge, and an upper side opposite to the carpet-facing side;

a plurality of trailing cotton-heads disposed on the carpet-facing side behind and transverse to the leading edge;

a plurality of pin-teeth disposed on the carpet-facing side and interspersed between the plurality of trailing cotton-heads; and an adjustment mechanism for extending the plurality of trailing cotton-heads from the body, and for retracting the plurality of trailing cotton-heads towards the body.

14. The engaging head of claim 13, further comprising a second adjustment mechanism mounted to the body and connected to the plurality of pin-teeth, operative to extend the plurality of pin-teeth from the body and to retract the plurality of pin-teeth towards the body.

15. The engaging head of claim 13, further comprising an arcuate neck attached to the body and extending away from the upper side of the body and away from the leading edge of the body.

16. The engaging head of claim 13, further comprising a leading cotton-head disposed on the carpet-facing side of the body parallel and adjacent to the leading edge.

17. The engaging head of claim 16, wherein a portion of the body adjacent to the leading cotton-head is substantially wider in a direction parallel to the leading edge than a trailing portion of the body whereon the plurality of trailing cotton-heads and the plurality of pin teeth are disposed.

18. The engaging head of claim 17, wherein the body is a substantially T-shaped body.

19. An engaging head for a carpet stretcher, comprising:

a body, having a leading edge, a carpet-facing side extending in a trailing direction from the leading edge, and an upper side opposite to the carpet-facing side;

a plurality of cotton-heads disposed on the carpet-facing side behind and transverse to the leading edge;

a plurality of pin-teeth disposed on the carpet-facing side and interspersed between the plurality of cotton-heads;

an adjustment mechanism for extending the plurality of pin-teeth from the body, and for retracting the plurality of pin-teeth towards the body; and a leading cotton-head disposed on the carpet-facing side of the body, parallel and adjacent to the leading edge, wherein the body is a substantially T-shaped body.

20. The engaging head of claim 19, wherein the adjustment mechanism further comprises a knob disposed on the upper side of the body and connected to an actuator mechanism disposed under the upper side of the body by a shaft passing through the body, and wherein the body further comprises a boss on the upper side of the body interposed between the body and the knob.

* * * * *